US007168171B1

(12) United States Patent
Zaiser

(10) Patent No.: US 7,168,171 B1
(45) Date of Patent: Jan. 30, 2007

(54) DRUM DEHEADER

(75) Inventor: Gary Zaiser, Nashotah, WI (US)

(73) Assignee: Hydro-Thermal Corp., Waukesha, WI (US)

( * ) Notice: Subject to any disclaimer, the term of this patent is extended or adjusted under 35 U.S.C. 154(b) by 0 days.

(21) Appl. No.: 11/103,113

(22) Filed: Apr. 11, 2005

Related U.S. Application Data

(60) Provisional application No. 60/561,471, filed on Apr. 12, 2004.

(51) Int. Cl.
*B67B 7/50* (2006.01)

(52) U.S. Cl. ..... 30/431; 30/428; 30/432

(58) Field of Classification Search ..... 30/400, 30/429, 431, 432, 435, 437, 442, 443, 445, 30/444, 450, 428
See application file for complete search history.

(56) References Cited

U.S. PATENT DOCUMENTS 146,355 A * 1/1874 Paillard et al. ..... 30/431
1,111,163 A * 9/1914 Millar ..... 30/428
1,507,572 A * 9/1924 Bennett ..... 30/431
1,648,881 A * 11/1927 Parsons ..... 30/431
1,662,172 A * 3/1928 Schaefer ..... 30/431
1,709,861 A * 4/1929 Meier ..... 30/431
3,117,373 A 1/1964 Wallace
3,745,650 A 7/1973 Derwin
4,169,313 A 10/1979 Thurmond, Jr.
5,361,502 A 11/1994 Derwin
5,802,725 A 9/1998 Drifka et al.

* cited by examiner

*Primary Examiner*—Hwei-Siu Payer
(74) *Attorney, Agent, or Firm*—Andrus, Sceales, Starke & Sawall

(57) ABSTRACT

A drum deheader is adapted for use with a cylindrical drum having a sidewall, a cover at opposite ends of the sidewall and an annular chime joining each cover to the sidewall. A receiver is adapted to be positioned against the sidewall and is engaged with the chime. A slide plate assembly is adapted for vertical sliding movement within the receiver and carries a cutting blade adapted to engage the cover. An elongated handle is pivotally mounted to the receiver for operably moving the cutting blade upwardly and downwardly into and out of cutting engagement with the cover. The invention is improved by a follower and slot arrangement formed in the handle, the receiver and the slide plate for enabling the upward and downward movement of the cutting blade as the operating handle is pivotally moved.

6 Claims, 7 Drawing Sheets

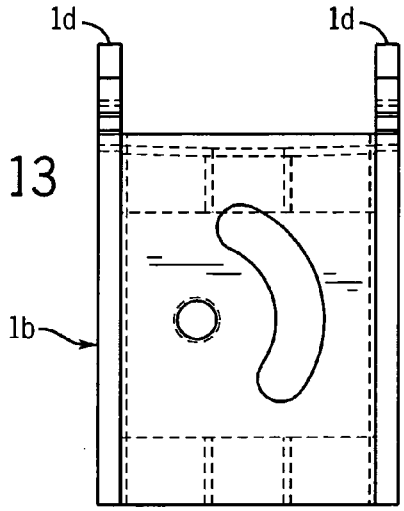
FIG. 13
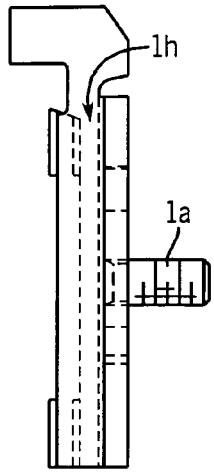
FIG. 14
FIG. 15
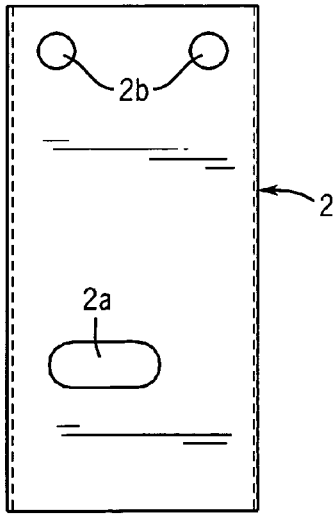
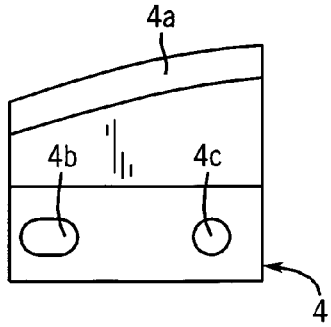
FIG. 17
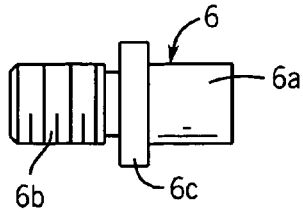
FIG. 18
FIG. 16
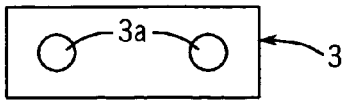

DRUM DEHEADER

This application relates to and claims priority from Provisional U.S. Patent Application Ser. No. 60/561,471 filed Apr. 12, 2004.

FIELD OF THE INVENTION

The present invention relates broadly to a drum cutting apparatus for removing the end cover of a metal drum by sequential shearing, and more particularly, pertains to a deheader having a manually operable leverage linkage for advancing a blade into cutting relation with the end cover and retracting the blade therefrom.

BACKGROUND OF THE INVENTION

Large industrial metal drums of 30 gallon and 55 gallon capacity normally have a metal cover that is secured to an upper edge of the cylindrical wall of the drum by an annular rim or chime. Metal drum openers can be used to cut and remove the metal drum cover so that the drums may be reused after their original sealed contents have been exhausted.

One known type of manually operable drum deheader includes a cutting blade attached to a slide plate slidably mounted in a channel-like receiver which engages the annular chime of the drum. An elongated handle is pivotally mounted to the receiver and connected by a double hinged linkage for reciprocating the blade upwardly and downwardly to cut through the cover of the drum. A guide handle can be attached to the slide plate so that it extends away from the drum. While this double hinged or pivoted design has been generally satisfactory, there is a need for an improved deheader which is more rigid and stable, and is more economical to manufacture.

SUMMARY OF THE INVENTION

It is a general object of the present invention to provide a manually operable, drum deheader which will easily sever the end of a steel drum without requiring prodigious labor.

It is also an object of the present invention to provide a drum deheader employing a single pivot and follower arrangement which is simple and relatively inexpensive to fabricate, and which operates efficiently and performs a satisfactory shearing operation.

It is a further object of the present invention to provide a drum deheader which is easy to apply and remove with respect to a metal drum, and to guide around the annular chime of the drum.

In one aspect of the invention, a drum deheader is adapted for use with a cylindrical drum having a sidewall, a cover at opposite ends of the sidewall and an annular chime joining each cover to the sidewall. A receiver is adapted to be positioned against the sidewall and engaged with the chime. A slide plate assembly is adapted for vertical sliding movement within the receiver and carries a cutting blade adapted to engage the cover. An elongated operating handle is pivotally mounted to the receiver for operably moving the cutting blade upwardly and downwardly into and out of cutting engagement with the cover. The invention is improved by means of a follower and slot arrangement formed in the handle, the receiver and the slide plate assembly for enabling the upward and downward movement of the cutting blade as the operating handle is pivotally moved.

In another aspect of the invention, a drum deheader is adapted for use on a cylindrical drum having a sidewall, a cover at opposite ends of the sidewall and an annular chime joining each cover to the sidewall. The deheader includes a receiver adapted to be positioned against the sidewall with the receiver being formed with a curved slot and a pair of hooked flanges adapted to engage the chime. A slide plate assembly is disposed for vertical sliding movement within the receiver. The slide plate assembly is formed with a linear slot alignable with the curved slot, a cutting blade adapted to engage the cover and a guide handle projecting therefrom. An elongated operating handle has one end pivotally connected to the receiver about a pivot pin and is provided with a drive pin spaced from the pivot pin and engaged in the aligned curved and linear slots. Pivotal movement of the operating lever will cause the cutting blade to move vertically upwardly and downwardly into and out of cutting and severing engagement with the cover of the drum.

Various other objects, features and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 13 is an elevational view of the assembled channel weldment;

FIG. 14 is an end view of FIG. 13;

FIG. 15 is an elevational view of a slide plate which slides between the channel and the support plate;

FIG. 16 is an elevational view of a blade spacer;

FIG. 17 is an elevational view of the cutting plate;

FIG. 18 is an elevational view of a drive pin;

DETAILED DESCRIPTION OF THE INVENTION

Figure 1:
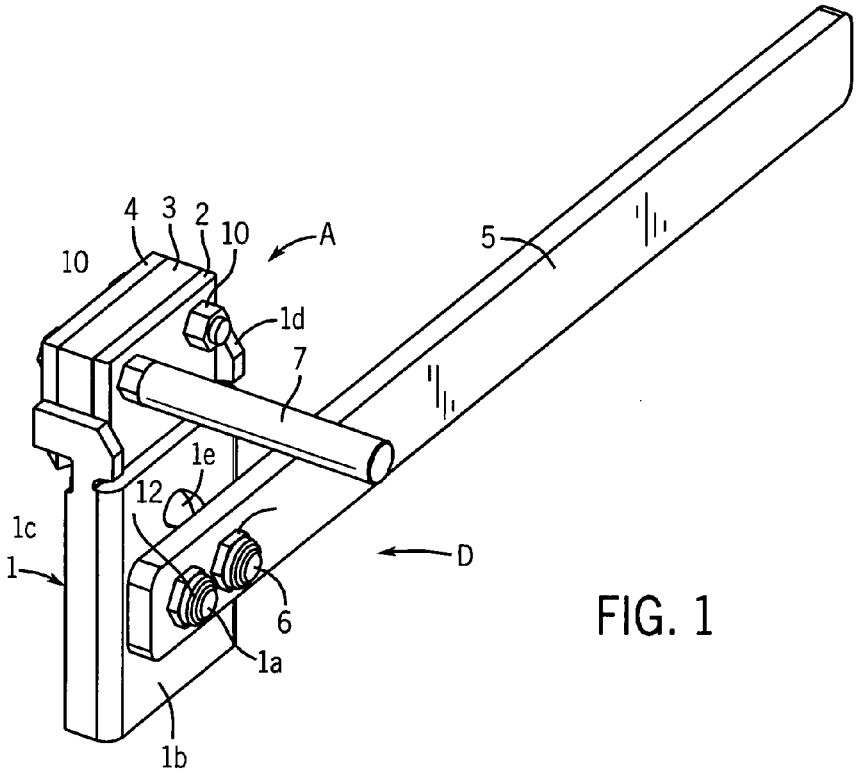
FIG. 1 is a perspective view of the drum deheader embodying the present invention.
Figure 2:
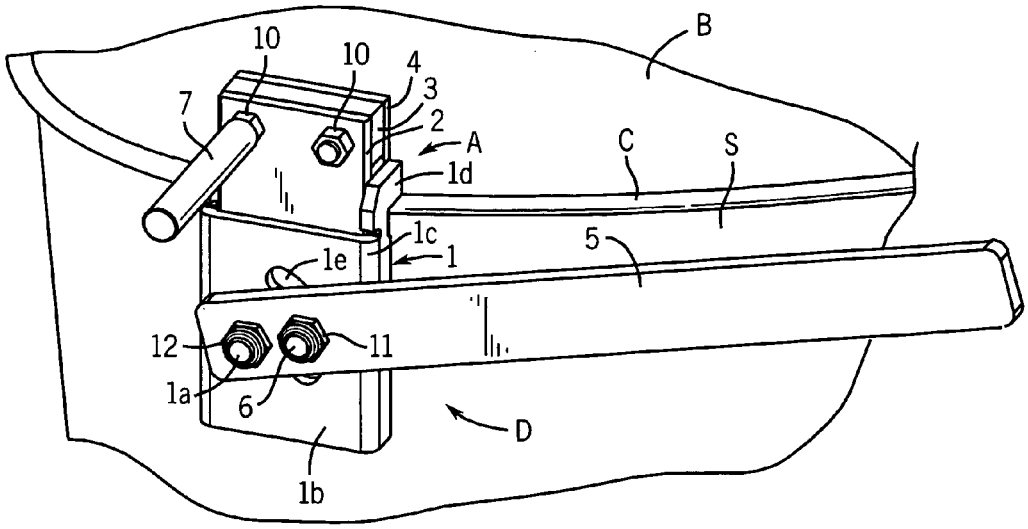
FIG. 2 is a rear perspective view of the drum deheader positioned on the chime of a drum.
Figure 3:
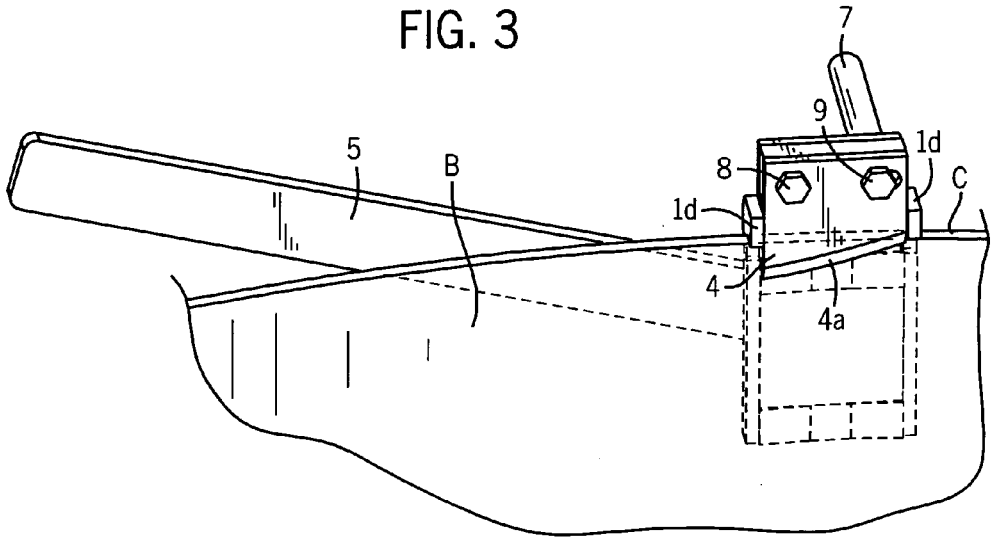
FIG. 3 is a partial, front perspective view of the drum deheader of FIG. 2.
Figure 4:
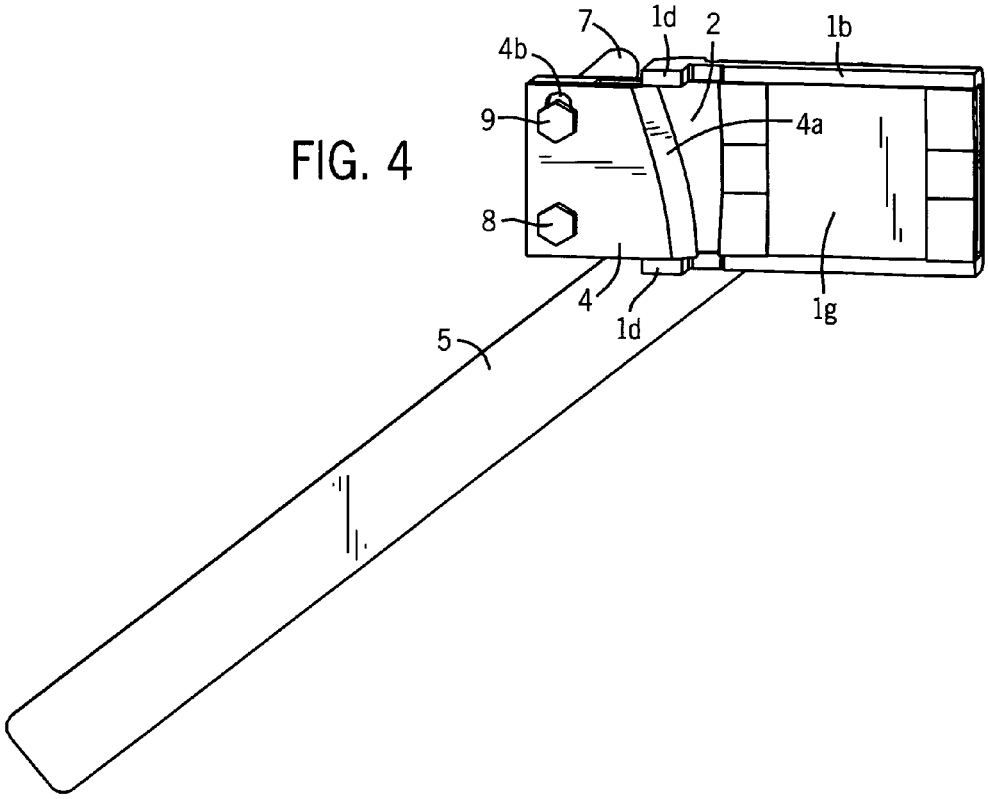
FIG. 4 is a further front perspective view of the drum deheader detached from the drum.

Referring now to the drawings, FIGS. 1–3 illustrate a drum deheader A embodying the present invention. The deheader A is shown in a cutting mode positioned on an annular chime C of a metal drum D having an end cover B.

The deheader A is comprised generally of a receiver or channel weldment 1 having a pivot pin 1*a*, a slide plate 2, a blade spacer 3, a cutting blade 4, an elongated operating handle 5, a follower or drive pin 6, and a guide handle 7.

Figure 8:
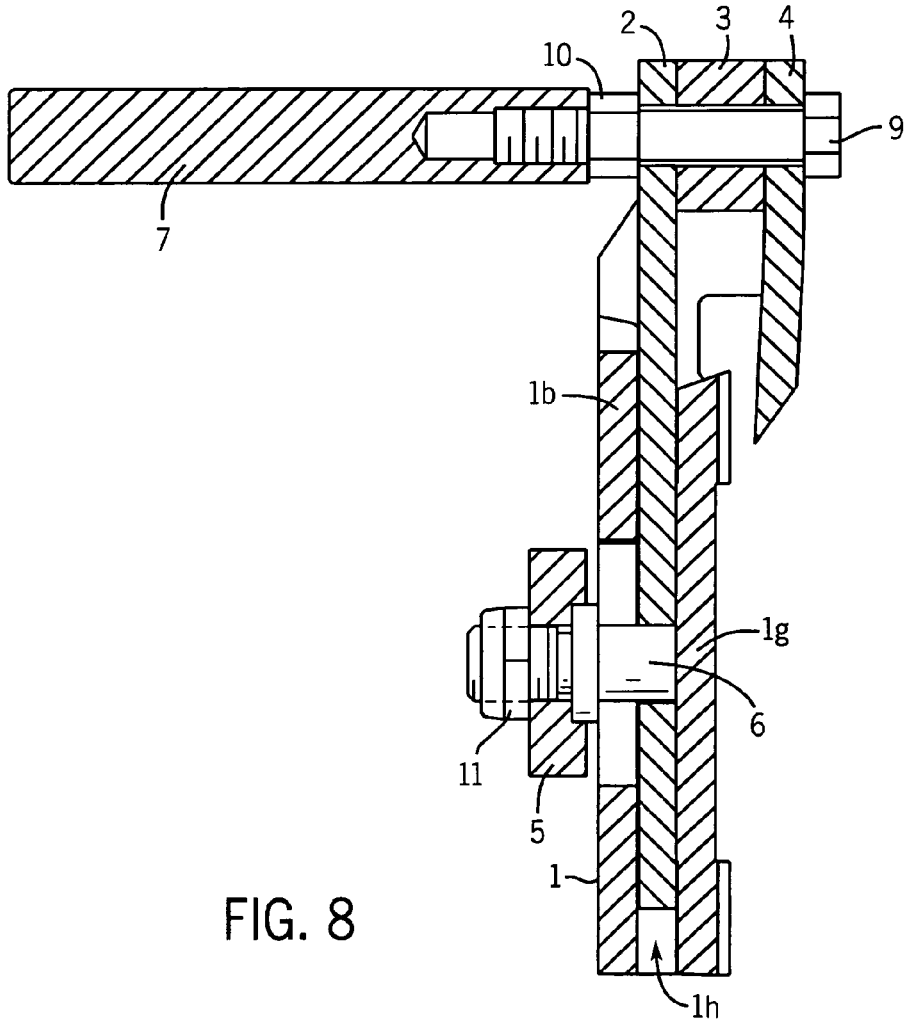
FIG. 8 is a sectional view taken on line 7—7 of FIG. 7.
Figure 9:
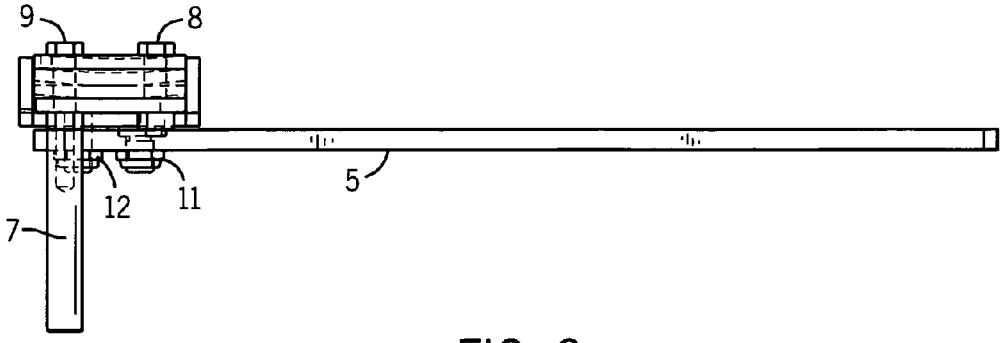
FIG. 9 is a plan view of the drum deheader in FIG. 7.
Figure 10:
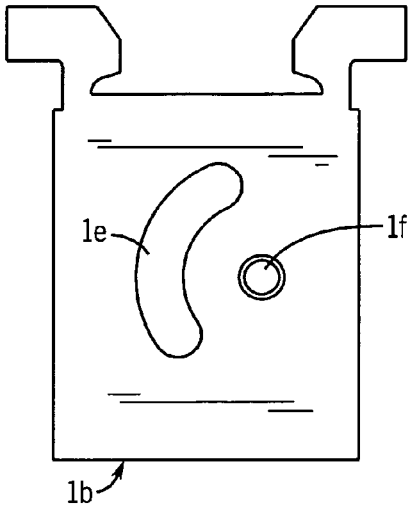
FIG. 10 is a rear elevational view of a channel forming the front portion of a channel weldment.
Figure 11:
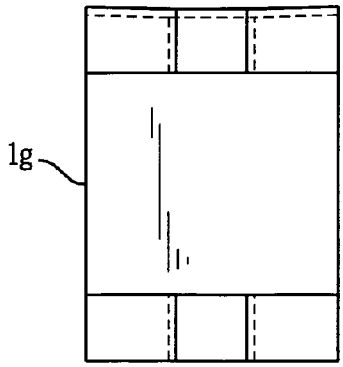
FIG. 11 is an elevational view of a support plate welded to the rear of the channel.
Figure 12:
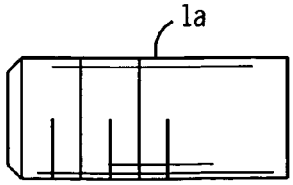
FIG. 12 is an elevational view of a lever arm pivot pin welded to the channel.

Channel weldment 1 includes a channel 1*b* (FIG. 10) provided with rounded side edges 1*c* and hooked flanges 1*d* at its upper end as best seen in FIGS. 2 and 3. The channel 1*b* is formed with a curved slot 1*e* and a hole 1*f* having a surrounding wall into which the pivot pin 1*a* (FIG. 12) is received and retained by welding. A support plate 1*g* (FIG. 11) is welded to the rear edges of the channel 1*b* in spaced relationship therefrom to define a space 1*h* as best seen in FIGS. 8 and 14. The assembled channel weldment 1 (FIG. 13) serves as a receiver for slide plate 2 which is slidably disposed for vertical movement between the channel 1*b* and the support plate 1*g*.

The slide plate 2 (FIG. 15) is provided with a horizontally disposed, linear slot 2*a* in a lower portion, and a pair of spaced apart openings 2*b* in an upper portion. The blade spacer 3 (FIG. 16) has a pair of recesses 3*a* which are aligned with the openings 2*b* of the slide plate 2. The cutting blade 4 (FIG. 17) has an angled, beveled edge 4*a* and a pair of apertures 4*b*, 4*c* which are registered with openings 2*b* and recesses 3*a*. Aperture 4*b* is slightly enlarged relative to the size of aperture 4*c*. With the blade spacer 3 interposed between the slide plate 2 and the cutting blade 4, two bolts 8, 9 are passed through the aligned openings 2*b*, recesses 3*a* and apertures 4*b*, 4*c*. Two hex nuts 10 are threaded onto respective threaded ends of the bolts 8, 9 to hold the slide plate 2, blade spacer 3 and cutting blade 4 together to form a slide plate assembly. The threaded end of bolt 9 is slightly longer than the threaded end of bolt 8 to enable the attachment of the guide handle 7 thereto as noted in FIG. 8.

Figure 19:
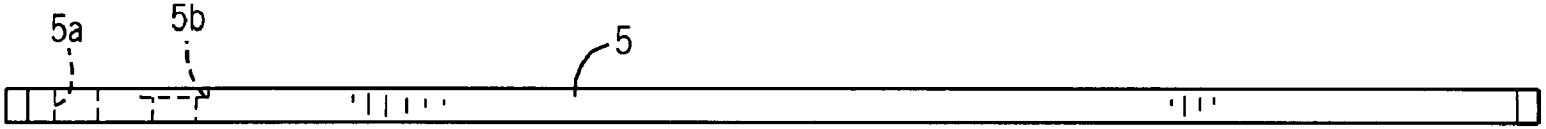
FIG. 19 is a bottom view of an operating handle.
Figure 20:
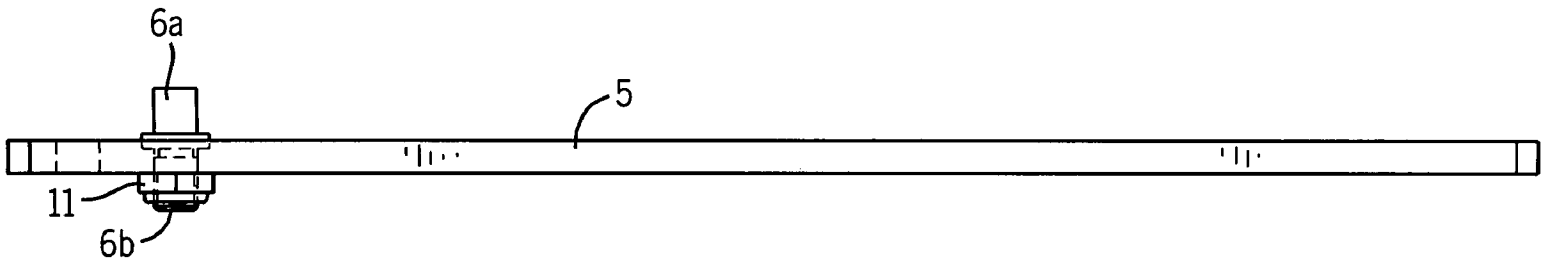
FIG. 20 is a top view of the operating handle with the drive pin installed.

FIG. 19 shows a top view of the elongated operating handle 5 which is formed at one end with a hole 5*a* for accommodating pivot pin 1*a*, and a countersunk opening 5*b* for receiving a central portion 6*c* of the drive pin 6. One end portion 6*a* of drive pin 6 protrudes from a rear base of handle 5, and an opposite end portion 6*b* extends from a front face of a handle 5 as shown in FIG. 20. The opposite end portion 6*b* is threadedly engaged with a nut 11 so as to hold the drive pin 6 in place relative to the handle 5.

Figure 5:
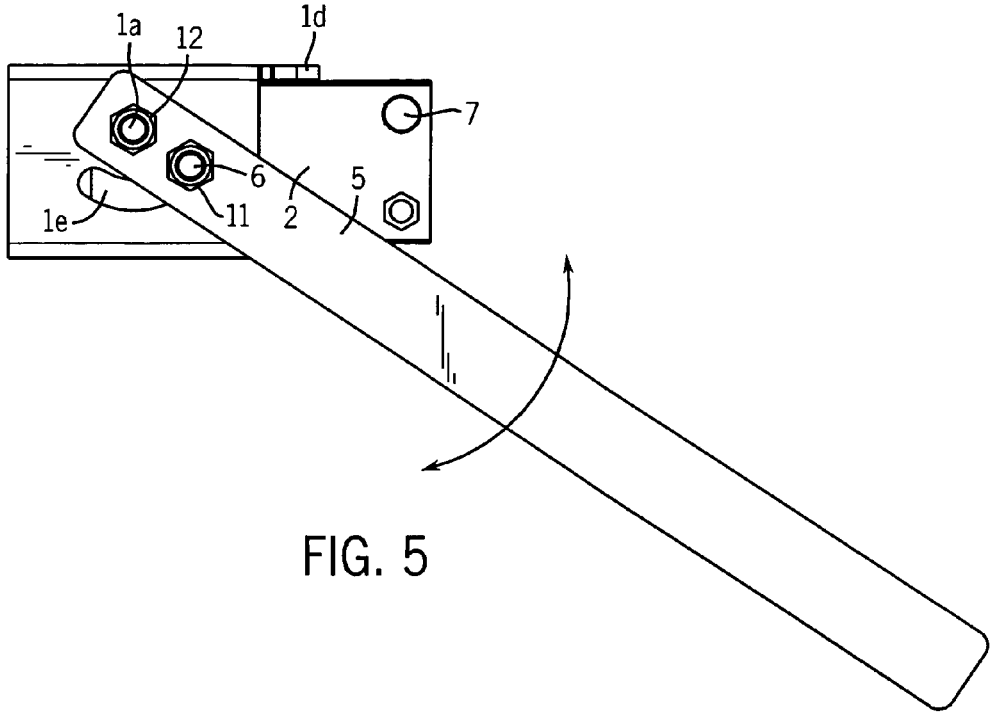
FIG. 5 is an operational front view of the drum deheader of FIG. 4 in a raised position which will move the blade upwardly.
Figure 6:
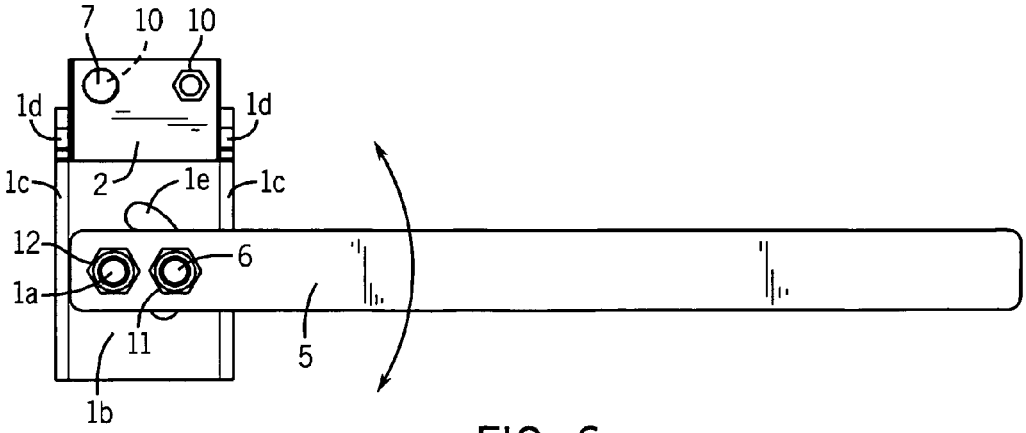
FIG. 6 is another operational front view of the drum deheader in a lowered position which will move the blade downwardly.
Figure 7:
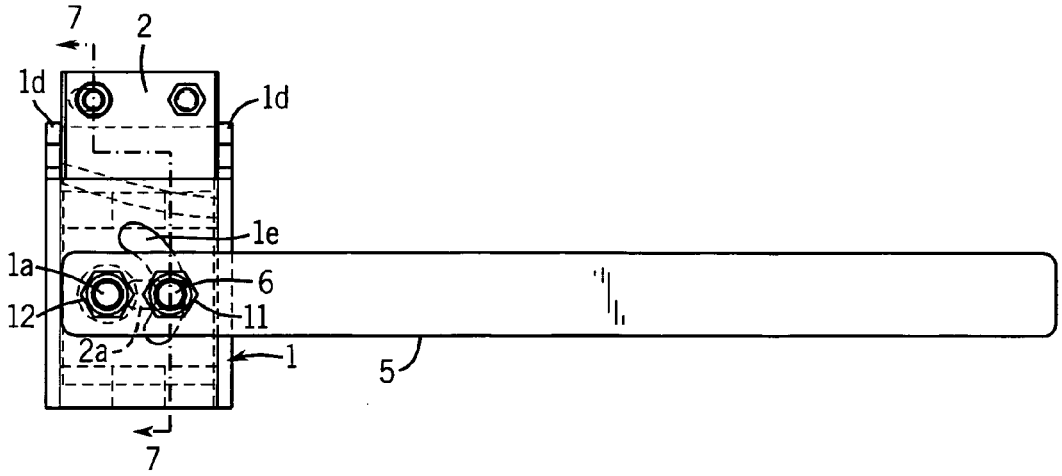
FIG. 7 is a more detailed front view of the drum deheader of FIG. 6.

When the slide plate 2 is slidably inserted in the space 1*h*, the horizontally disposed, linear slot 2*a* therein is aligned with the curved slot 1*e* in the channel 1*b*, and the opposite end portion 6*b* of drive pin 6 on handle 5 extends through the aligned slots 1*e*, 2*a* as seen in FIG. 8. Hole 5*a* in handle 5 receives pivot pin 1*a* which is held in place by nut 12 so that the handle 5 is pivotally mounted on the channel 1*b*. With this construction, the drive pin 6 acts as a follower so that, upon upward movement of the handle 5 about pivot pin 1*a* (FIG. 5), the follower 6 causes the slide plate 2 and the attached cutting blade 4 to move upwardly. Downward movement of the handle 5 about pivot pin 1*a* (FIG. 6) results in moving the slide plate 2 and cutting blade 4 downward.

In use, (FIGS. 2 and 3), when it is desired to sever and remove end cover B from metal drum D, the deheader A is positioned so that the hooked flanges 1*d* engage a section of the chime C, and the support plate 1*g* lies adjacent a sidewall S of the drum D. The operator places one hand on a distal gripping end of operating handle 5 and the other hand on the guide handle 7. The operator then raises the operating handle 5 to elevate the cutting blade 4 over a segmental portion of the end cover B coextensive with the bottom of the chime C between the hooked flanges 1*d*. Then, the operator pulls downwardly on operating handle 5 causing the cutting blade 4 to descend and shear the end cover segment, the cut being made progressively from a leading end to a trailing end of the angled, beveled edge 4*a*. The procedure is repeated around the entire periphery of the chime C until the cover B is completely severed.

For use in hazardous areas, the deheader A has a non-ferrous construction to help minimize sparking towards flammable materials during the shearing operation.

It should be appreciated that the present invention provides an improved manually operable, highly leveraged drum deheader A which employs a single pivot axis and a follower/slot arrangement that provides for a more rigid, stable assembly that is more economical to manufacture. The deheader A continues to provide convenient, efficient and accurate shearing of drum end covers with a minimum of operator effort.

While the invention has been described with reference to a preferred embodiment, those skilled in the art will appreciate that certain substitutions, alterations and omissions may be made without departing from the spirit thereof. Accordingly, the foregoing description is meant to be exemplary only and should not be deemed limitative on the scope of the invention set forth with the following claims.

I claim:

1. In a drum deheader adapted for use with a cylindrical drum having a sidewall, a cover at each end of the sidewall and an annular chime joining each cover to the sidewall, the deheader including a receiver adapted to be positioned against the sidewall and adapted to be engaged with the chine, a slide plate assembly mounted for vertical sliding movement within the receive and carrying a cutting blade adapted to engage the cover, and an elongated handle pivotally mounted to the receiver for operably moving the cutting blade upwardly and downwardly, the cutting blade being adapted to move into and out of cutting engagement with the cover, the improvement comprising:

a follower and slot arrangement formed in the handle, the receiver and the slide plate assembly for enabling the upward and downward movement of the cutting blade as the elongated handle is pivotally moved, wherein the elongated handle is pivotally mounted at one end about a pivot pin to the receiver, and wherein the follower and the slot arrangement includes a curved slot formed in the receiver and, a linear slot formed in the slide plate assembly and alignable with the curved slot.

2. The improvement of claim 1, wherein the elongated handle is pivotally mounted to the receiver about a single pivot axis.

3. The improvement of claim 1, wherein the follower and slot arrangement includes a drive pin projecting from the elongated handle in spaced relationship with the pivot pin, the drive pin being engaged in the aligned curved and linear slots.

4. A drum deheader adapted for use on a cylindrical drum having a sidewall, a cover at each end of the sidewall and an annular chime joining each cover to the sidewall, the deheader comprising:

a receiver adapted to be positioned against the sidewall, the receiver being formed with a curved slot and a pair of hooked flanges adapted to engage the chime;

a slide plate assembly disposed for vertical sliding movement in the receiver, the slide plate assembly being formed with a linear slot alignable with the curved slot, a cutting blade adapted to engage the cover and a guide handle projecting therefrom;

and an operating handle having one end pivotally connected to the receiver about a pivot pin and provided with a drive pin spaced from the pivot pin and engaged in the aligned curved and linear slots, whereby pivotal movement of the operating handle causes the cutting blade to move vertically upwardly and downwardly into and out of cutting and severing engagement with the cover of the drum.

5. The drum deheader of claim 4, wherein the pivot pin is located on the receiver.

6. The drum deheader of claim 4, wherein the slide plate assembly includes a spacer interposed between a slide plate and the cutting blade.

* * * * *